United States Patent [19]

Birmingham

[11] Patent Number: 5,035,365

[45] Date of Patent: Jul. 30, 1991

[54] THORTVEITITE ORE BENEFICIATION PROCESS

[75] Inventor: Scott D. Birmingham, Platteville, Colo.

[73] Assignee: Boulder Scientific Company, Mead, Colo.

[21] Appl. No.: 480,534

[22] Filed: Feb. 15, 1990

[51] Int. Cl.[5] ..... B02C 23/08

[52] U.S. Cl. ..... 241/14; 241/24

[58] Field of Search ..... 241/14, 24

[56] References Cited

U.S. PATENT DOCUMENTS

| | | | |
|---|---|---|---|
| 3,204,877 | 9/1965 | Barr, Jr. et al. | 241/14 |
| 3,754,713 | 8/1973 | Klenast et al. | 241/24 |
| 4,834,811 | 5/1989 | Keem et al. | 241/24 |

*Primary Examiner*—Timothy V. Eley

*Attorney, Agent, or Firm*—Edward S. Irons

[57] ABSTRACT

A thorteveitite ore beneficiation process which comprises comminuting the ore by wet autogenuous grinding to substantially liberate the thortveitite contained therein, and passing the comminuted ore through a nonuniform magnetic field to produce a concentrate and a tailing, the concentrate containing a substantially greater percentage of thortveitite than the ore.

13 Claims, 2 Drawing Sheets

THORTVEITITE ORE BENEFICIATION PROCESS

FIELD OF THE INVENTION

This invention relates to the separation of impurities from ores containing thortveitite $(Sc,Y)_2Si_2O_7$, a rare scandium silicate. More particularly, this invention relates to the magnetic separation of thortveitite from gangue or other types of impurities.

DESCRIPTION OF PRIOR ART

Thortveitite from Norway and Madagascar has been used as a source of scandium. At these localities, the thortveitite is found in crystals of sufficient size to be separated from the host rock by hand-picking. No other practical technique is known for upgrading any thortveitite containing ores. In part, for that reason, thortveitite has not been utilized as a scandium source.

SUMMARY OF THE INVENTION

This invention involves the discovery that most if not all thortveitite is paramagnetic. Bianchi, et. al, Am. Mineral., 73, 601-607 (1988), reports thortveitite having stoichiometric iron content of 3.29 weight percent, but with no reference to magnetism.

The method of this invention yields concentrates from which scandium, yttrium, ytterbium and other rare earth elements may be extracted either directly or after further processing.

Pursuant to the invention, comminuted thortveitite containing ores are passed through a nonuniform magnetic field. Separation occurs because of a magnetic susceptibility differential between the thortveitite and the gangue and other impurities. Another aspect of the invention entails magnetic processing as a part of a multistep beneficiation process. For example, magnetic processing may precede or follow other beneficiation procedures such as flotation or electrostatic fractionation in any sequence. In one form of the invention, thortveitite ore is first subjected to magnetic processing, the concentrate is subjected to froth flotation and the froth product is subjected to a second stage of magnetic processing.

DETAILED DESCRIPTION OF THE INVENTION

Figure 1:
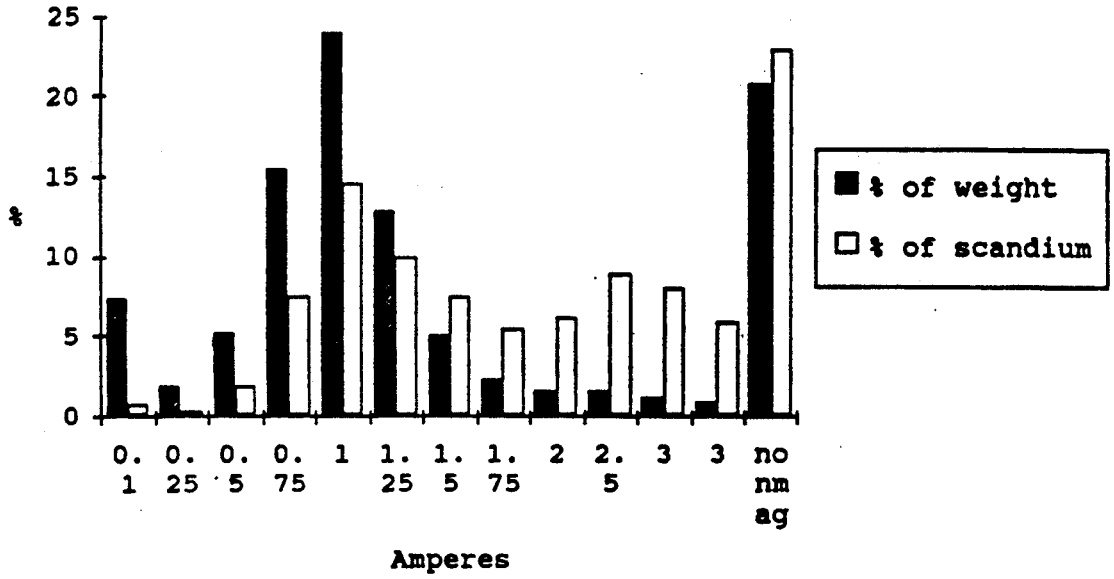
FIG. 1 is a bar graph showing the results of processing a thortveitite ore with a dry, induced roll lift-type magnetic separator.

Thortveitite ores commonly contain various silicates, mainly quartz and feldspar, but may also contain micaceous silicates, sulfides, oxides, fluorite and other minerals.

Heterogeneous distribution of non-stoichiometric iron or paramagnetic inclusions in thortveitite causes a wide range of magnetic susceptibilities. Within a sufficiently large population of crystals, thortveitite may be magnetic over a very wide range of field strengths.

This invention yields thortveitite ore concentrates from which scandium and other rare earth elements can be economically and practically extracted. In particular, the invention yields thortveitite or concentrates which contain from at least about 5,000 to about 35,000 parts per million of scandium depending upon the starting material.

Prior to magnetic processing, the ore must be reduced by grinding or other form of communation to a size necessary to liberate the thortveitite and to allow the ore to pass freely through a magnetic separation device. Grinding of the thortveitite ore is normally accomplished by wet autogenous grinding, although dry grinding can be accomplished in hammer mills, ball mills, Raymond mills, pin mills, and ceramic tube type mills. The necessary size of the ground ore depends on intrinsic characteristics of the ore, but the ore should be less than 10 mesh, preferably from about 10 mesh to about 200 mesh, for optimal results.

Thortveitite ores which contain slime or fine particles that form coatings or cause agglomeration are preferably washed or classified to produce a clean, free-flowing sand. This washing, or desliming step, can take place either prior to or after grinding. Washing or desliming of the thortveitite ore is normally accomplished in a hydrocyclone, or by mechanical or hydraulic clarification, wet screening or other methods with the addition soda ash or sodium hydroxide to provide a dispersant effect on the mineral particles. The clean, ground ore must then be dried if separation of the thortveitite is to be accomplished by dry magnetic separation.

It has been found as a part of this invention that thortveitite, once liberated from occluded minerals and reduced to a clean, free-flowing sand, can be magnetically separated from gangue with different magnetic susceptibilities using roll-type, lift-type, cross-belt, belt, wet-drum, and other types of magnetic or beneficiation devices. Magnetic separators using high-intensity permanent rare earth magnets are preferred inasmuch as some thortveitite may be only weakly magnetic. In general, the higher the coercive force exerted by the magnet, the more effective the separation from non- or less magnetic minerals.

Magnetic separators utilizing a electrically induced magnetic field or those which utilize other types of permanent magnets produce parallel results; increases in the coercive force exerted by the magnet increase the recovery of thortveitite into the magnetic fraction. Other examples of permanent magnets which are capable of exerting the coercive force necessary to separate thortveitite are contained in the following Magnetic Materials Producer's Association (MMPA) classes: alnico (section II), ceramic (section III), rare earth (section IV), and iron-chromium-cobalt (section V) and other magnetically hard materials with a coercive force greater than about 120 oersteds (*MMPA Guidelines on Measuring Unit Properties of Permanent Magnets*). Wet magnetic separation can also concentrate thortveitite into a magnetic fraction subject to the same coercive strength/recovery relationships as with dry magnetic separation.

Now having generally described this invention, the following examples illustrate specific application of the invention.

EXAMPLE 1

Magnetic separation of thortveitite using a roll-type separator with high-intensity neodymium-iron-boron permanent magnets (energy product: $B_dH_d=35$ megagauss- oersted) is shown in Table 1.

TABLE 1

Results of processing a thortveitite ore with a dry, roll-type magnetic separator equipped with a high-intensity neodymium-iron-boron permanent magnet roll.

| Sample | Wt. % of feed | ppm Sc | % of Sc |
|---|---|---|---|
| 1.8 tons/hr.; 8-30 mesh | | | |
| feed | | 1040 | |
| magnetic 1 | 8.27 | 12050 | 95.8 |
| magnetic 2 | 2.31 | 1100 | 2.4 |
| nonmagnetic | 89.42 | 20 | 1.7 |
| 1.5 tons/hr.; 8-30 mesh | | | |
| feed | | 953 | |
| magnetic | 10.80 | 8500 | 96.3 |
| nonmagnetic | 89.20 | 39 | 3.7 |
| 1.5 tons/hr.; 30-100 mesh | | | |
| feed | | 1509 | |
| magnetic 1 | 25.85 | 5140 | 88.1 |
| nonmagnetic | 74.15 | 243 | 11.9 |
| 2.1 tons/hr.; 30-100 mesh | | | |
| feed | | 1357 | |
| magnetic 1 | 18.95 | 5450 | 76.1 |
| magnetic 2 | 4.56 | 5240 | 17.6 |
| nonmagnetic | 76.49 | 112 | 6.3 |

Thortveitite is the only mineral in this ore containing significant quantities of scandium, thus analyses of scandium directly correlate with the recovery of thortveitite. Table 1 shows that for different mesh sizes and different roll speeds, that as much as 95.8% of the thortveitite can be recovered in 8.27% of the weight of the starting ore. The ore was upgraded from approximately 1,050 to 12,050 ppm scandium in the process. If the nonmagnetic fraction from such a test is recycled, an additional 2.4% of the scandium can be recovered yielding a concentrate with about 9,660 ppm scandium. The fractions labeled "magnetic 2" are magnetic minerals recovered through such recycling. The other test results reported in Table 1 show the effectiveness of this method diminishes slightly for sand between 30 and 100 mesh, but that it is still a useful method for recovering thortveitite. High-intensity magnetic separation of thortveitite is more effective than at lower intensity because the low magnetic susceptibility of much of the thortveitite.

EXAMPLE 2

Figure 2:
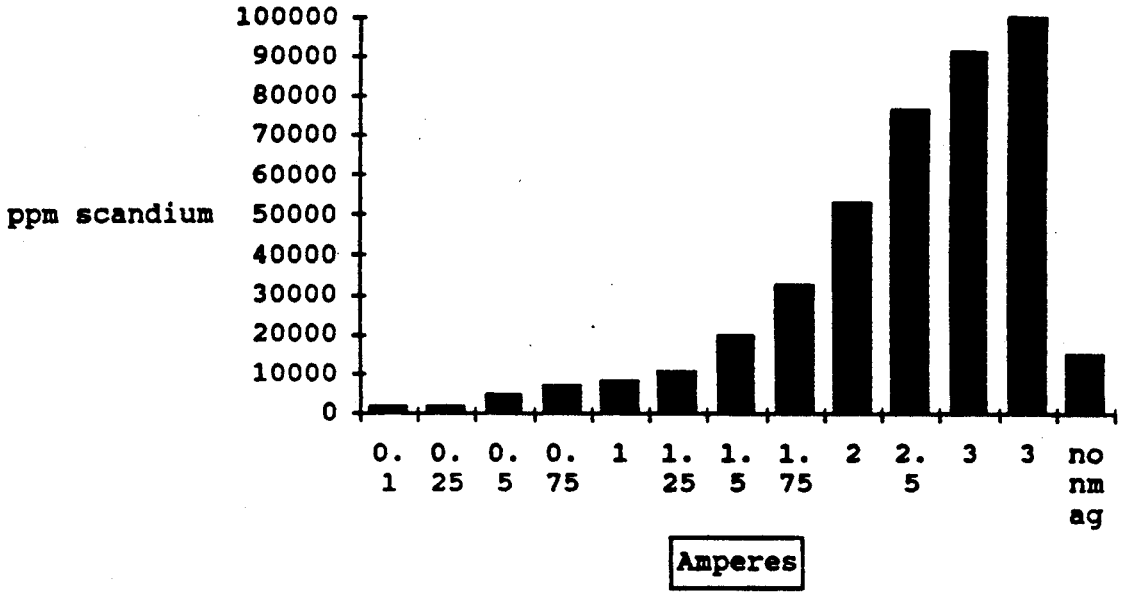
FIG. 2 is a graph showing the results of processing a thortveitite ore with a dry, induced roll lift-type magnetic separator on scandium concentration.

The effectiveness of magnetic separation of thortveitite was measured by collecting magnetic samples from 0.25 to 3.0 amperes at 0.25 ampere intervals on a lift-type induced roll magnetic separator patented by Carpco, Inc.. The nonmagnetic portion from the 0.25 ampere test served as feed for the 0.50 ampere test and so on. FIG. 2 shows that the scandium, and thus thortveitite, is collected over a wide range of amperages but nearly 25% behaves as if it is nonmagnetic below 3.0 amperes. The weaker field strength of an induced roll magnetic separator or one using lower intensity permanent magnets, can have some utility for removing highly magnetic minerals. If, for instance, in FIG. 2 only the fractions between 1.5 and 3.0 amperes are collected and then combined, a thortveitite concentrate could be obtained yielding about 27,000 ppm scandium with about 53% recovery. Since nearly all of the thortveitite in the nonmagnetic portion can be recovered with a high-intensity magnetic separator, the total recovery can be increased to about 78% contained in approximately 20% of the starting weight. Inasmuch as magnetic separation of thortveitite using a weaker field than can be obtained with a high-intensity separator produces poorer recoveries, it can allow for the production of very enriched scandium concentrates from suitable starting materials. FIG. 2 shows the exponential increase in scandium/thortveitite concentration produced by increasing the field strength of an induced roll.

EXAMPLE 3

Wet methods of magnetic separation of thortveitite produce results similar to those obtained by dry methods. As with dry separation, the recovery of thortveitite/scandium correlates positively with increasing field strength. Table 2 shows the result of a wet high-gradient (20,000 gauss) magnetic separation of a thortveitite ore containing 11,300 ppm scandium.

TABLE 2

| Sample | Wt. % of feed | ppm Sc | % of Sc |
|---|---|---|---|
| feed | | 11300 | |
| magnetite product | 12.0 | 6000 | 6.1 |
| magnetic | 24.0 | 34140 | 66.7 |
| nonmagnetic | 64.0 | 4800 | 27.2 |

In this test, a concentrate was produced with about 34,000 ppm scandium at 66.7% recovery in 24% of the feed weight. At a lower intensity (<2,000 gauss), about 12% of the weight was rejected into a magnetite product with 6.1% of the total scandium.

I claim:

1. A thortveitite ore beneficiation process which comprises (i) comminuting said ore to substantially liberate the thortveitite contained therein (ii) passing said comminuted ore through a nonuniform magnetic field to produce a concentrate and a tailing said concentrate containing a substantially greater percentage of thortveitite than said ore.

2. A process as defined by claim 1 in which said ore is comminuted to an average particle size of less than 10 mesh.

3. A process as defined by claim 2 in which said ore is comminuted to an average particle size of from about 8 to about 30 mesh.

4. A process as defined by claim 1 in which the ore is deslimed.

5. A process as defined by claim 1 in which said ore is deslimed prior to step 1.

6. A process as defined by claim 1 in which said ore is deslimed after comminuting step (i) and prior to step (ii).

7. A process as defined by claim 1 in which said concentrate is recycled at least once through step (ii) to produce a second concentrate.

8. A process as defined by claim 1 in which said tailing is recycled at least once through step (ii).

9. A process for separating thortveitite from admixture with nonmagnetic impurities which comprises passing said admixture through a nonuniform magnetic field to produce a thortveitite concentrate and a tailing comprising said impurities.

10. A process as defined by claim 9 in which said admixture is a thortveitite ore froth flotation concentrate.

11. A thortveitite ore beneficiation process which comprises (i) comminuting said ore by wet autogenuous grinding to substantially liberate the thortveitite contained therein, (ii) passing said comminuted ore through a nonuniform magnetic field to produce a concentrate and a tailing, said concentrate containing a substantially greater percentage of thortveitite than said ore.

12. A process as defined by claim 11 in which said ore is comminuted to an average particle size of less than 10 mesh.

13. A process as defined by claim 12 in which said ore is comminuted to an average particle size of from about 8 to about 30 mesh.

* * * * *

UNITED STATES PATENT AND TRADEMARK OFFICE

CERTIFICATE OF CORRECTION

PATENT NO. : 5,035,365
DATED : July 30, 1991
INVENTOR(S) : Scott D. Birmingham

It is certified that error appears in the above-identified patent and that said Letters Patent is hereby corrected as shown below:

Claim 3,
Line 1, "2" is changed to -- 1 --.

Claim 13,
Line 1, "12" is changed to -- 11 --.

Signed and Sealed this

Twenty-eighth Day of August, 2001

*Attest:*

Nicholas P. Godici

*Attesting Officer*

NICHOLAS P. GODICI
*Acting Director of the United States Patent and Trademark Office*